United States Patent [19]

Pichler

[11] Patent Number: 4,735,287

[45] Date of Patent: Apr. 5, 1988

[54] LUBRICATING SYSTEM FOR A FUEL-INJECTION PUMP

[75] Inventor: Helmut Pichler, Stuttgart, Fed. Rep. of Germany

[73] Assignee: Daimler-Benz Aktiengesellschaft, Stuttgart, Fed. Rep. of Germany

[21] Appl. No.: 897,342

[22] Filed: Aug. 18, 1986

[30] Foreign Application Priority Data

Aug. 16, 1985 [DE] Fed. Rep. of Germany ..... 3529420

[51] Int. Cl.[4] ..... F01M 1/00

[52] U.S. Cl. ..... 184/6.8; 184/18; 417/490

[58] Field of Search ..... 184/6.8, 18; 417/490, 417/494, 499, 501

[56] References Cited

U.S. PATENT DOCUMENTS

| | | | |
|---|---|---|---|
| 1,899,949 | 3/1933 | Fahrney | 184/18 X |
| 2,410,947 | 11/1946 | Johnson | 417/494 X |
| 3,186,344 | 6/1965 | Hogeman | 184/18 X |

FOREIGN PATENT DOCUMENTS

| | | | |
|---|---|---|---|
| 697009 | 10/1940 | Fed. Rep. of Germany | 417/494 |
| 877981 | 5/1953 | Fed. Rep. of Germany | 417/494 |
| 1249012 | 8/1967 | Fed. Rep. of Germany | 184/6.2 |
| 881546 | 11/1961 | United Kingdom | 417/494 |

*Primary Examiner*—Leonard E. Smith

[57] ABSTRACT

A fuel-injection pump with a rotational speed governor for an internal combustion engine which for purposes of lubrication is connected to the lubricating oil circulatory system of the internal combustion engine. The lubricating oil which is thereby removed from the lubricating oil circulation is conducted by way of a pressure oil line and an inlet bore in the pump housing to a plunger cylinder of the injection pump and is controlled by the plunger sliding within the plunger cylinder by way of an aperture into a discharge bore terminating in the governor housing. From the governor housing, the lubricating oil flows over into the cam shaft space and is returned from the same by way of a return opening to the lubricating oil circulation of the internal combustion engine.

14 Claims, 1 Drawing Sheet

FIG. 1
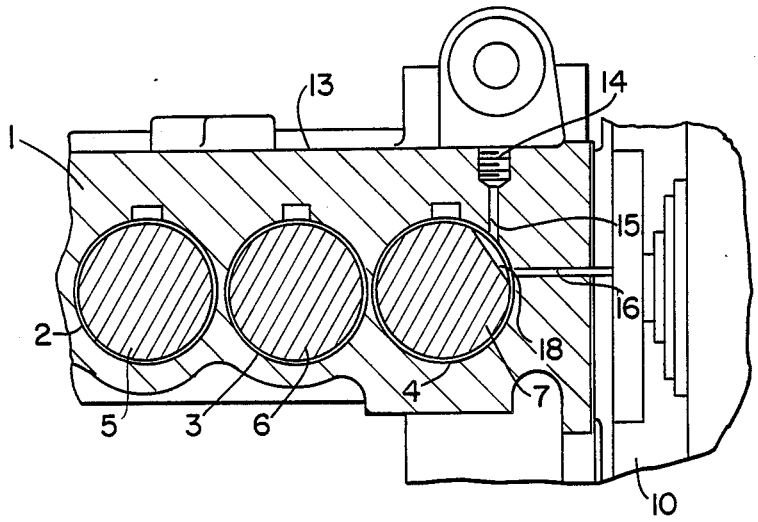
FIG. 2
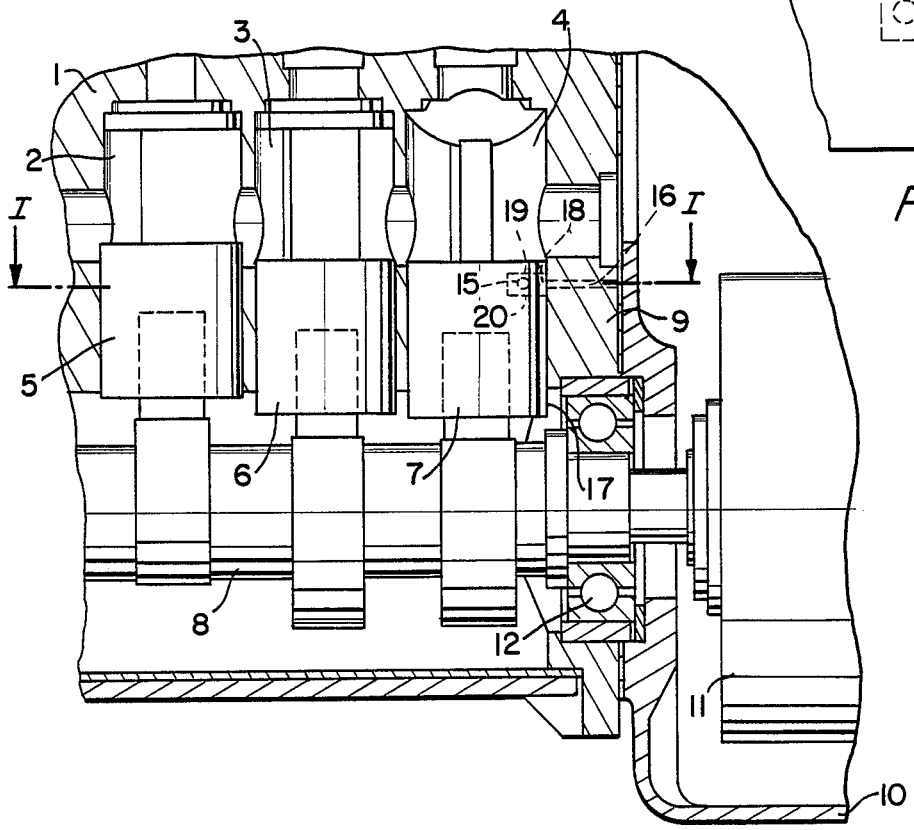
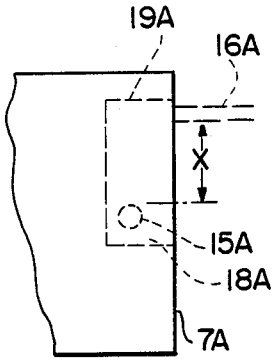
FIG. 3

LUBRICATING SYSTEM FOR A FUEL-INJECTION PUMP

The present invention relates to a fuel injection pump with a rotational speed governor for an internal combustion engine and with a pressure oil line connected to the lubricating oil circulation of the internal combustion engine which is connected with an inlet bore in the pump housing that terminates in a plunger cylinder in which is guided a plunger with an aperture arranged in the plunger shank through which lubricating oil for the lubrication of the pump cam shaft space and of the governor housing flangedly connected to the pump housing flows during overlap with the inlet bore.

A fuel injection pump of this type is disclosed in the DE-AS No. 12 49 012. The lubricating oil which for purposes of lubricating the pump drive unit is removed from the lubricating oil circulatory system of the internal combustion engine is conducted by way of a pressure oil line and an inlet bore in the pump housing to a plunger cylinder and from there through a bore in the plunger periodically into the cam shaft space. The metering of the lubricating oil quantity is thereby controlled by the bore in the plunger which during a rotation of the cam shaft opens up the inlet bore twice for short periods of time. The cam shaft space thereby fills with lubricating oil whereby, beginning with a predetermined oil lever, lubricating oil which is continued to be supplied, is displaced by way of an equalizing bore in the plunger into a plunger spring space located above the cam shaft space. An overflow line extending parallel to the cam shaft axis is connected to the plunger spring space which terminates in the governor housing and into which the excess lubricating oil is conducted from the cam shaft space for the lubrication of the governor housing. The lubricating oil is then returned from the governor housing to the lubricating oil circulatory system of the internal combustion engine.

Of disadvantage with this prior art arrangement is the large oil quantity in the cam shaft space necessary for the lubrication of the governor housing which is connected with an excessive oil work of the drive unit parts moving in the cam shaft space. Additionally, the oil requirement of the internal combustion engine increases thereby. Added thereto is the fact that as a result of the considerable oil work, the lubricating oil heats up very strongly as a result of which the pressure in the cam shaft space may rise to such an extent that temporarily interruptions in the lubricating oil supply may occur. Furthermore, it must be considered that as a result of the strong oil heat up the pump housing becomes very hot which may lead to undesired changes in the density of the fuel to be supplied by the pump. Finally, the manufacturing expenditure for the manufacture of the bores for the conduction of the lubricating oil out of the cam shaft space into the governor housing has been found to be disadvantageous.

The present invention is now concerned with the task to so construct the lubricating oil circulatory system in the known fuel-injection pump that at low lubricating oil level in the cam shaft space an optimum lubrication of all drive unit parts of the fuel injection pump is achieved with a smallest possible defined lubricating oil quantity.

The underlying problems are solved according to the present invention in that a discharge bore connected to the plunger cylinder and controlled by the aperture in the plunger shank is provided which terminates in the governor housing and by which lubricating oil is conducted out of the pressure oil line directly into the governor housing during overlap with the aperture, whereby the lubricating oil flows over from the governor housing into the cam shaft space.

As a result of the arrangement of the discharge bore in the pump housing in accordance with the present invention, a lubricating oil circulation results in the pump in a particular manner, according to which initially the governor housing and in the discharge direction of the lubricating oil the cam shaft space is supplied. Furthermore, a distribution or metering of the lubricating oil quantity in dependence of the lubricating oil level in the lubricating spaces of the pump is achieved with the present invention so that only small lubricating oil quantities are required in the pump housing for the lubrication. Finally, the manufacturing expenditures for the pump are also reduced because at least the overflow bore in the plunger can be dispensed with.

According to a further feature of the present invention, the aperture is constructed as a groove machined into the plunger shank.

According to still further features of the present invention, the desired lubricating oil quantity to be controlled can be constructively determined in a simple manner in conjunction with the groove depth in that in the upper dead-center position of the plunger the groove is arranged with its upper control edge in or shortly above the plane of inlet and discharge bore and in that the lower control edge has a spacing from the upper control edge which is equal to or smaller than the plunger stroke. Furthermore, the inlet and discharge bore may be arranged offset in the stroke direction of the plunger by an amount which is equal to or smaller than the desired groove width.

With an arrangement of the groove and discharge bore at the last plunger cylinder, a relatively short discharge bore results which can be easily manufactured from the pump rear face.

The lubricating spaces of the fuel injection pump are customarily filled with a minimum lubricating oil quantity prior to the first test run of the internal combustion engine. This takes place simultaneously with the first filling of the lubricating system of the internal combustion engine whereby, however, the filling of internal combustion engine and injection pump takes place each separately. In order to now achieve that with the first filling of the lubricating system of the internal combustion engine also the fuel-injection pump can be filled at the same time with lubricating oil, the groove is arranged at the plunger shank in such a manner according to a further feature of the present invention that the supply and discharge bore are in flow communication with each other with the fuel injection pump adjusted to feed beginning. The predetermination of the feed beginning adjustment thereby offers the advantage that the cam shaft and therewith the plungers assume an exactly predetermined position in the pump housing, by reference to which the arrangement of the groove can be constructively determined without difficulty at one of the plungers. After the feed beginning of the injection pump is additionally fixedly adjusted to the feed beginning mark of the engine, it is sufficient for the common filling of the internal combustion engine and pump when the internal combustion engine is adjusted to feed beginning mark.

These and other objects, features and advantages of the present invention will become more apparent from the following description when taken in connection with the accompanying drawing which shows, for purposes of illustration only, one embodiment in accordance with the present invention, and wherein:

FIG. 1 is a partial horizontal longitudinal cross-sectional view taken along line I—I of FIG. 2 through the end of the pump housing on the side of the governor of a fuel-injection pump in accordance with the present invention;

FIG. 2 is a vertical longitudinal cross-sectional view through the pump housing of FIG. 1; and FIG. 3 is an enlarged schematic depiction of an alternative embodiment of the invention with the lubricant inlet and outlet bores disposed in different planes.

Referring now the drawing wherein like reference numerals are used throughout the two views of FIGS. 1 and 2 to designate like parts, several, for example, six plunger cylinders arranged in line are provided in the pump housing 1 of which only the three plunger cylinders 2, 3, and 4 are illustrated which are located at the end of the housing on the side of the governor. Plungers 5, 6 and 7 are inserted into the plunger cylinders 2, 3 and 4 which are actuated from a pump cam shaft 8. A governor housing 10 is flangedly connected to the end face 9 of the pump housing 1 on the side opposite the driving side, in which is arranged a governor generally designated by reference numeral 11 and connected with the cam shaft 8. The cam shaft 8 and the rotational speed governor 11 are thereby supported in the end face 9 within a roller bearing 12.

The lubrication of the individual drive unit parts of the injection pump arranged in the pump housing 1 as well as in the governor housing 10 takes place from the lubricating oil circulatory system of the internal combustion engine. The lubricating oil taken out of the lubricating oil circulatory system is thereby fed to the pump housing by way of a pressure oil line (not shown). A screw-in opening 14 for the connection of the pressure oil line is thereby provided at a lateral wall 13 of the pump housing at the height of the last plunger cylinder 4. An inlet bore 15 extending transversely to the housing longitudinal axis leads from the inlet bore 14 which terminates in the cylinder section of the plunger cylinder 4 facing the end face 9. Furthermore, a discharge bore 16 is connected to this cylinder section with a spacing from the discharge of the inlet bore, but lying in the same horizontal cylinder cross plane; the discharge bore 16 is extended in parallel to the longitudinal housing axis through the end face 9 and terminates in the governor housing 10. A groove 18 is provided in the plunger shank 17, by way of which the inlet bore 15 and the discharge bore 16 are connected with each other for a short period of time during the stroke movement of the plunger 7; this means, always when the groove 18 overlaps both bore openings, lubricating oil is conducted into the governor housing 10. The lubricating oil then flows from the governor housing 10 through the roller bearing 12 and through an equalizing opening possibly provided in the end face 9 into the cam shaft space 8 and is again conducted off into the lubricating oil circulation from the cam shaft space 8 by way of a return bore.

The groove 18 is thereby so positioned at the plunger shank 17 that in the upper dead-center position of the plunger 7 its upper control edge 19 lies in or shortly above the plane of inlet bore 15 and discharge bore 16. Depending on the desired lubricating oil quantity to be carried off, the lower control edge 20 has a distance from the upper control edge 19 which is equal to or smaller than the plunger stroke whereby a large distance, which means a wide groove signifies a large oil quantity and a small distance, which means a narrow groove, signifies a small oil quantity. A change of the oil quantity is also achieved in the preferred embodiment depicted in FIG. 3 wherein like reference numerals, with the suffix A, are used to indicate like structure as in the FIG. 1 and 2 embodiment. In FIG. 3 the inlet bore 15A and discharge bore 16A are arranged offset in the stroke direction of the plunger 7A by an amount which is equal to or smaller than the desired groove width. The inlet bore 15A and discharge bore 16A are offset by a distance X, which arrangement, together with the size of the groove 18A serves to control the oil quantity and timing in dependence on the position of plunger 7A.

Within the scope of the present invention, the control of the oil quantity can also take place from other plunger cylinders. Furthermore, also other groove positions than those described hereinabove are feasible. Such a groove position is, for example, characterized in that the groove 18 overlaps the inlet bore 15 and the discharge bore 16 whenever the fuel-injection pump reaches its feed beginning position. Since the feed beginning of the injection pump is matched to the feed beginning mark of the internal combustion engine, a direct connection between the lubricating oil circulatory system of the internal combustion engine and the lubricating spaces of the injection pump exists every time when the internal combustion engine reaches the feed beginning mark, as a result of which it is possible to fill both lubricating systems at the same time in one operation during the first filling.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A fuel-injection pump with a rotational speed governor for an internal combustion engine and with a pressure oil line operable to be connected to the lubricating oil circulation of the internal combustion engine, comprising pump housing means, an inlet bore provided in the pump housing means operable to be connected with the pressure oil line, the inlet bore terminating in a plunger cylinder means in which is guided a plunger means having an aperture means arranged in its plunger shank, a governor housing means flangedly connected to the pump housing means, lubricating oil for the lubrication of the pump-cam shaft space and of the governor housing means flowing through the aperture means during overlap with the inlet bore, a discharge bore in the pump housing means connected to the plunger cylinder means and controlled by said aperture means, said discharge bore terminating in the governor housing means, and lubricating oil being conducted from the pressure oil line directly into the governor housing means during overlap of the discharge bore with the aperture means, the lubricating oil flowing over from the governor housing means into the cam shaft space, and the lubricating oil being returned from the cam shaft space to the lubricating oil circulation by way of a return opening.

2. A fuel-injection pump according to claim 1, with a marking provided at the pump housing means and with a marking at one of cam shaft or drive unit part rotating together with the cam shaft for the adjustment of the feed beginning, wherein the aperture means is so arranged at the plunger shank that during overlap of the markings, the inlet and discharge bore are in flow communication with each other.

3. A fuel-injection pump according to claim 1, wherein the inlet and discharge bore are arranged offset in the stroke direction of the plunger means by an amount which is at most equal to the selected aperture width.

4. A fuel-injection pump according to claim 3, wherein the inlet and discharge bore are arranged offset in the stroke direction of the plunger means by an amount which is smaller than the selected aperture width.

5. A fuel-injection pump according to claim 1, wherein in the upper-dead-center position of the plunger means the aperture means is arranged with its upper control edge approximately in the plane of inlet and discharge bore, and wherein the lower control edge has a distance from the upper control edge which is at most equal to the plunger stroke.

6. A fuel-injection pump according to claim 5, wherein said distance is smaller than the plunger stroke.

7. A fuel-injection pump according to claim 5, wherein the upper control edge is arranged shortly above the plane of inlet and discharge bore.

8. A fuel-injection pump according to claim 1, wherein the aperture means is constructed as a groove machined into the plunger shank.

9. A fuel-injection pump according to claim 8, wherein in the upper-dead-center position of the plunger means the groove is arranged with its upper control edge approximately in the plane of inlet and discharge bore, and wherein the lower control edge has a distance from the upper control edge which is at most equal to the plunger stroke.

10. A fuel-injection pump according to claim 9, wherein said distance is smaller than the plunger stroke.

11. A fuel-injection pump according to claim 10, wherein the upper control edge is arranged shortly above the plane of inlet and discharge bore.

12. A fuel-injection pump according to claim 9, wherein the inlet and discharge bore are arranged offset in the stroke direction of the plunger means by an amount which is at most equal to the selected groove width.

13. A fuel-injection pump according to claim 12, wherein the inlet and discharge bore are arranged offset in the stroke direction of the plunger means by an amount which is smaller than the selected groove width.

14. A fuel-injection pump according to claim 12, with a marking provided at the pump housing means and with a marking at one of cam shaft or drive unit part rotating together with the cam shaft for the adjustment of the feed beginning, wherein the groove is so arranged at the plunger shank that during overlap of the markings, the inlet and discharge bore are in flow communication with each other.

* * * * *